US007226404B2

(12) United States Patent
Rizzoli et al.

(10) Patent No.: US 7,226,404 B2
(45) Date of Patent: Jun. 5, 2007

(54) CIGARETTE FILTER ASSEMBLY MACHINE

(75) Inventors: Salvatore Rizzoli, Bologna (IT); Umberto Zanetti, Modena (IT); Fiorenzo Draghetti, Medicina (IT)

(73) Assignee: G.D Societa per Azioni, Bologna (IT)

( * ) Notice: Subject to any disclaimer, the term of this patent is extended or adjusted under 35 U.S.C. 154(b) by 496 days.

(21) Appl. No.: 10/349,662

(22) Filed: Jan. 23, 2003

(65) Prior Publication Data

US 2003/0168069 A1 Sep. 11, 2003

(30) Foreign Application Priority Data

Jan. 24, 2002 (IT) ..... BO2002A0039

(51) Int. Cl.
*B31C 13/00* (2006.01)

(52) U.S. Cl. ..... 493/48; 493/39; 493/50; 493/388; 131/56; 131/57; 131/57.5; 53/216; 53/587

(58) Field of Classification Search ..... 493/39, 493/46, 48, 50, 4, 386, 388; 131/56, 57, 131/57.5; 53/216, 587, 582
See application file for complete search history.

(56) References Cited

U.S. PATENT DOCUMENTS 4,640,013 A 2/1987 Cristian
4,848,371 A 7/1989 Belvederi
5,014,524 A * 5/1991 Smilovici ..... 66/64
5,695,441 A * 12/1997 Irikura ..... 493/47
5,887,595 A * 3/1999 Draghetti et al. ..... 131/29
5,928,124 A * 7/1999 Gherardi et al. ..... 493/459

FOREIGN PATENT DOCUMENTS

EP 0 620 984 10/1994
EP 0 867 127 3/1997

* cited by examiner

*Primary Examiner*—Christopher R. Harmon
(74) *Attorney, Agent, or Firm*—Marshall, Gerstein & Borun LLP

(57) ABSTRACT

A cigarette filter assembly machine wherein a rolling unit is defined by a rolling drum and a guide drum coaxial with each other and connected to each other in angularly-fixed, axially-sliding manner; and wherein the rolling drum has a number of suction rollers (54) rotated, with respect to the rolling drum, by respective independent drive units; the guide drum has a number of semicylindrical cavities, each coaxial, and defining a relative rolling channel, with a relative suction roller; the suction rollers receive, with a first spacing, relative groups of component parts of a relative double cigarette; and each drive unit rotates the relative suction roller to roll the relative group inside the relative rolling channel and to extract a relative double cigarette from the relative rolling channel, and reverses the relative suction roller to release the relative double cigarette with a second spacing smaller than the first spacing.

20 Claims, 7 Drawing Sheets

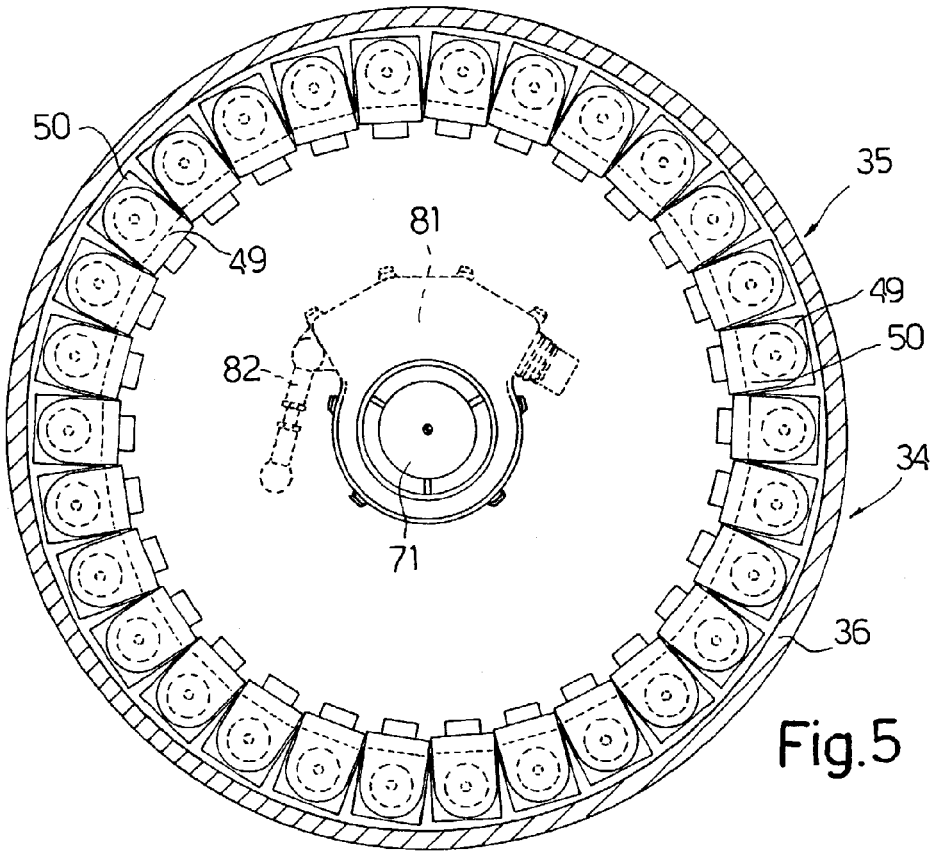
Fig.5
Fig.6
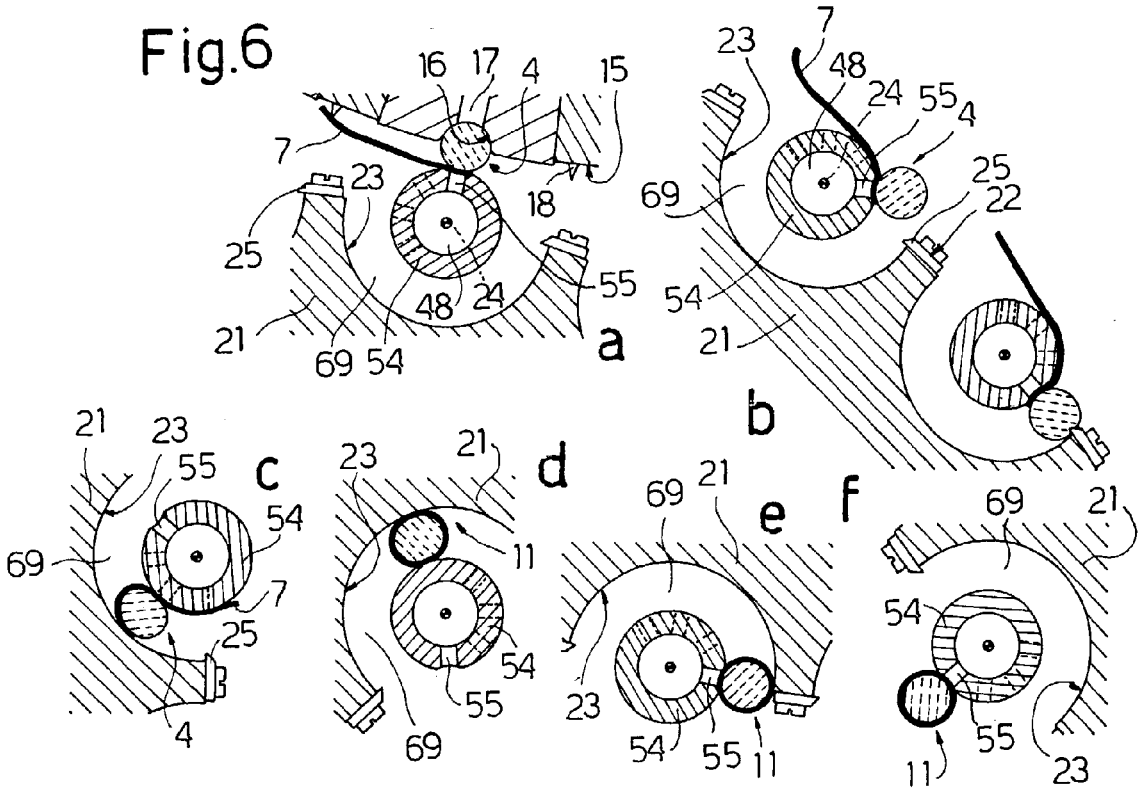

CIGARETTE FILTER ASSEMBLY MACHINE

The present invention relates to a cigarette filter assembly machine.

More specifically, the present invention relates to a cigarette filter assembly machine of the type comprising a rolling unit rotating about a first axis and interposed between a feed drum for supplying a succession of groups equally spaced with a first spacing and each defined by component elements of a relative double filter-tipped cigarette, and an output drum for receiving a succession of double cigarettes equally spaced with a second spacing; the rolling unit comprising a number of suction rollers mounted to rotate about respective second axes parallel to the first axis and equally spaced about the first axis; actuating means for rotating each suction roller about the relative second axis; and a number of semicylindrical cavities, each of which faces outwards, is coaxial with a relative second axis, and defines a relative rolling channel about a relative suction roller.

BACKGROUND OF THE INVENTION

Known machines of the above type, one of which is described for example in U.S. Pat No. 4,848,371, were substantially designed for the sole purpose of making rolling speed—i.e. the speed at which said groups are rotated about their axes during the rolling operation—at least partly independent of the rotation speed of the rolling unit about said first axis, and so enabling filter-tipped cigarettes to be produced at output rates which would be impossible if the two speeds were directly interdependent.

Though capable, for a given output rate, of performing the rolling operation at fairly slow speed, known machines of the above type have several drawbacks, mainly due to the suction rollers being activated by a single epicyclic gear train, in which a drive member (sun gear, carrier or ring gear) is powered directly by a drive shaft of the rolling unit, and the planet gears are connected angularly to the suction rollers. In other words, as opposed to being independent, the rolling speed and the rotation speed of the rolling unit of known machines of the above type are actually related by a given reduction ratio, and, above all, if the rotation speed of the rolling unit is constant, the same also applies to the suction rollers.

As a result, known machines of the above type are fairly "rigid" as regards sizing of the rolling unit, location of the rolling unit with respect to the feed and output drums, and selection of the rotation speeds of the rolling unit and suction rollers. Moreover, in known machines of the above type, the spacing of the groups supplied to the rolling unit, which is normally equal to the width of the connecting bands used to form the double cigarettes, is always equal to the spacing of the double cigarettes supplied to the output drum, and rolling initiation speed—i.e. the speed at which each group is fed into the relative rolling channel—cannot be adjusted.

SUMMARY OF THE INVENTION

It is an object of the present invention to provide a cigarette filter assembly machine of the above type, designed to eliminate the aforementioned drawbacks.

According to the present invention, there is provided a cigarette filter assembly machine comprising a rolling unit rotating about a first axis and interposed between a feed drum for supplying a succession of groups equally spaced with a first spacing and each defined by component elements of a relative double filter-tipped cigarette, and an output drum for receiving a succession of double cigarettes equally spaced with a second spacing; the rolling unit comprising a number of suction rollers mounted to rotate about respective second axes parallel to the first axis and equally spaced about the first axis; actuating means for rotating each suction roller about the relative second axis; and a number of semicylindrical cavities, each of which faces outwards, is coaxial with a relative second axis, and defines a relative rolling channel about a relative suction roller; the machine being characterized in that said actuating means comprise a number of independent reversible drive units, each connected to a respective said suction roller to rotate the suction roller about the relative said second axis at a speed varying according to a given law.

In a preferred embodiment of the machine defined above, said rolling unit comprises a rolling drum and a guide drum coaxial with each other and with said first axis; and first connecting means interposed between said guide drum and said rolling drum to connect the guide drum and the rolling drum to each other in angularly-fixed, axially-sliding manner; said suction rollers being supported by said rolling drum, and said guide drum carrying said cavities externally.

Each said drive unit preferably comprises a relative "brushless" motor having an output connected to a relative said suction roller, and preferably supported by said rolling drum.

Alternatively, each said drive unit comprises a relative sector gear which oscillates, according to a given law and preferably under control of a fixed cam, about a respective third axis parallel to a relative said second axis; and a pinion coaxial with said second axis, connected angularly to the relative said suction roller, and meshing with said sector gear.

BRIEF DESCRIPTION OF THE DRAWINGS

A number of non-limiting embodiments of the present invention will be described by way of example with reference to the accompanying drawings, in which:

FIG. 5 shows a section along line V—V in FIG. 3;

FIG. 6 shows a larger-scale view of a FIG. 4 detail in a succession of operating positions;

DETAILED DESCRIPTION OF THE INVENTION

Figure 1:
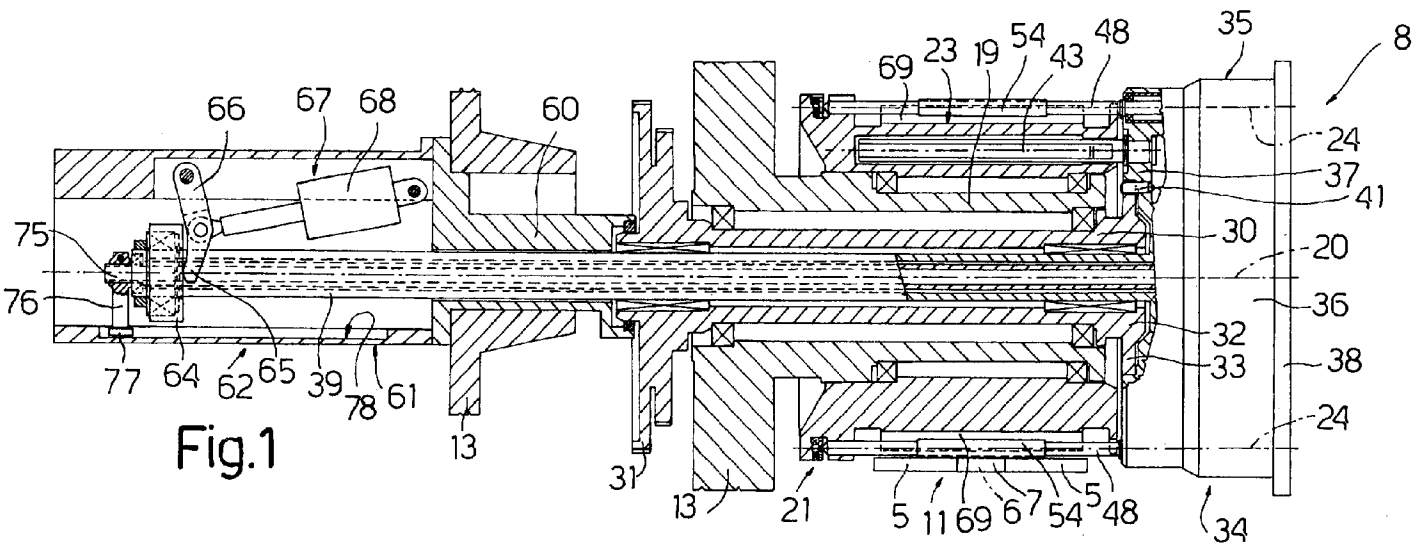
FIGS. 1 and 2 show schematic axial sections, in two different operating positions, of a rolling unit of a preferred embodiment of the filter assembly machine according to the present invention.
Figure 4:
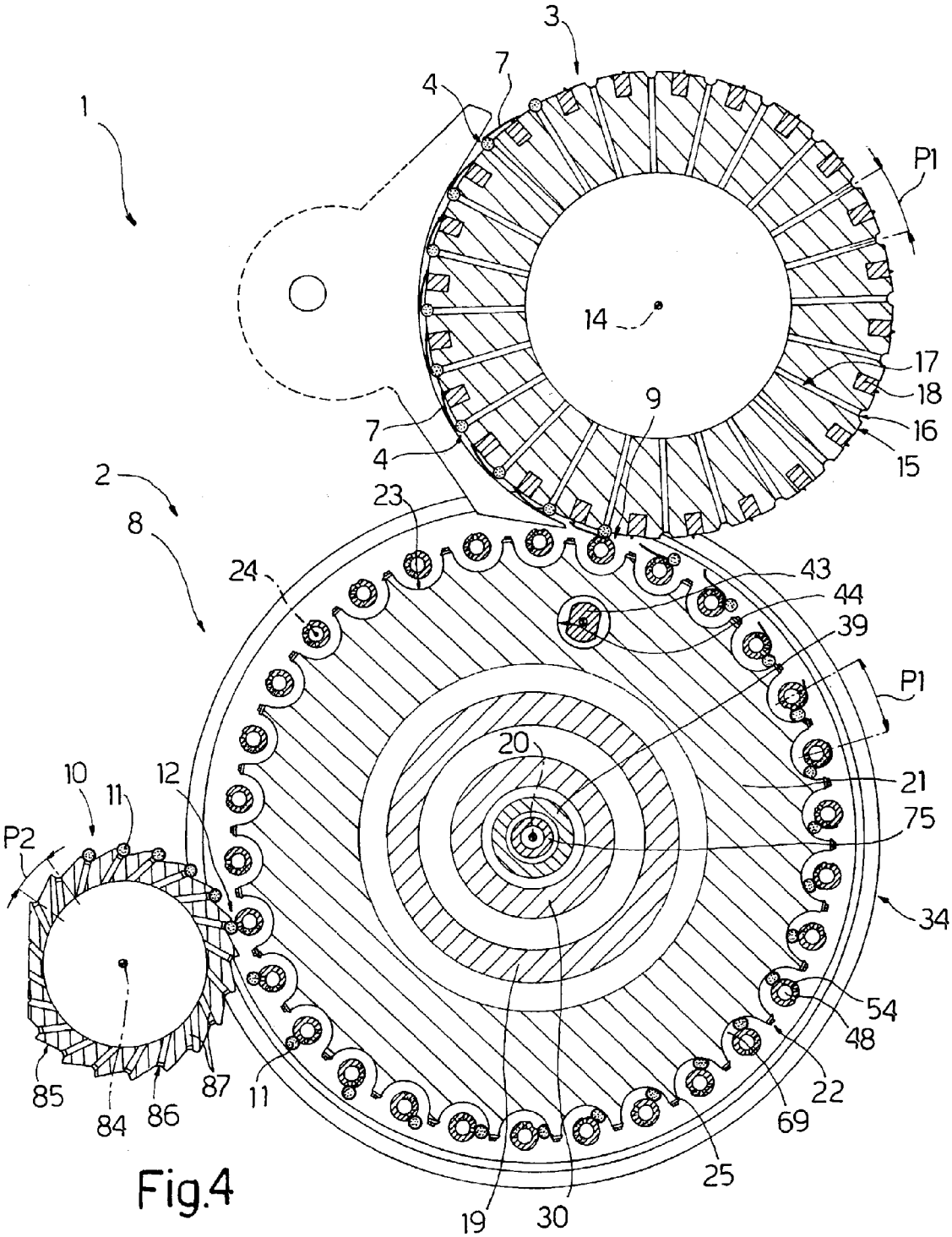
FIG. 4 shows a schematic cross section of a rolling assembly comprising the rolling unit in FIGS. 1 to 3.

With reference to FIG. 4, number 1 indicates as a whole a cigarette filter assembly machine comprising a rolling assembly 2, in turn comprising a feed drum 3 for supplying a succession of groups 4, each of which is defined, in the FIG. 1 example, by two cigarette portions 5, a double filter 6, and a double gummed band 7 for connecting double filter 6 to cigarette portions 5. Rolling assembly 2 also comprises a rolling unit 8 connected to feed drum 3 at a transfer and input station 9 of rolling unit 8; and an output drum 10 for receiving a succession of double cigarettes 11 from rolling 8 at a transfer and output station 12 of rolling unit 8.

Feed drum 3 is fitted to a fixed frame 13 (FIGS. 1 and 2) to rotate, with respect to frame 13, continuously and anticlockwise, in FIG. 4, about a horizontal axis 14, and comprises, on a lateral surface 15, a number of semicylindrical longitudinal seats 16 equally spaced with a spacing P1 about axis 14 and for receiving and retaining respective groups 4 by suction by means of radial suction channels 17. More specifically, each seat 16 receives two cigarette portions 5 separated by a double filter 6, and the relative double band 7 adheres by one lateral end to and along an outer generating line of cigarette portions 5 and double filter 6, projects rearwards of relative seat 16, and rests at the other lateral end on a support 18 projecting outwards from lateral surface 15 and interposed between relative seat 16 and the adjacent upstream seat 16 in the rotation direction of feed drum 3. To prevent interference between double bands 7, spacing P1 is at least equal to the width of each double band 7.

Figure 2:
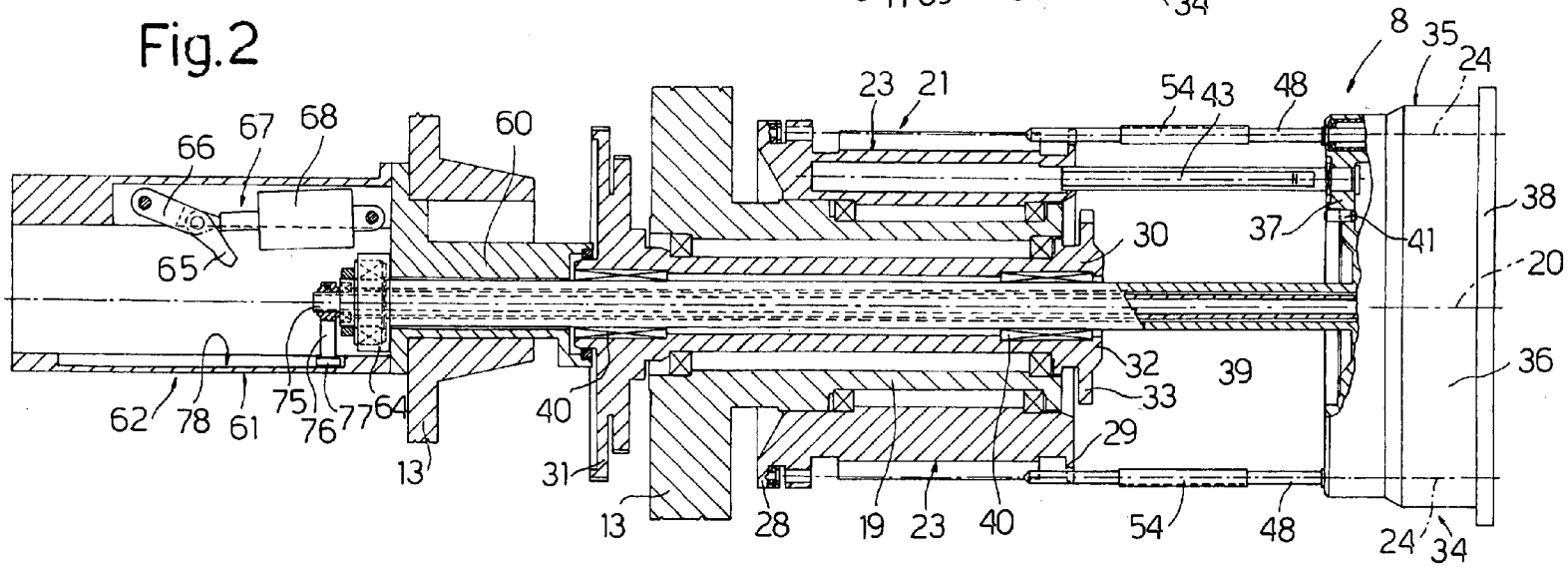
Figure 3:
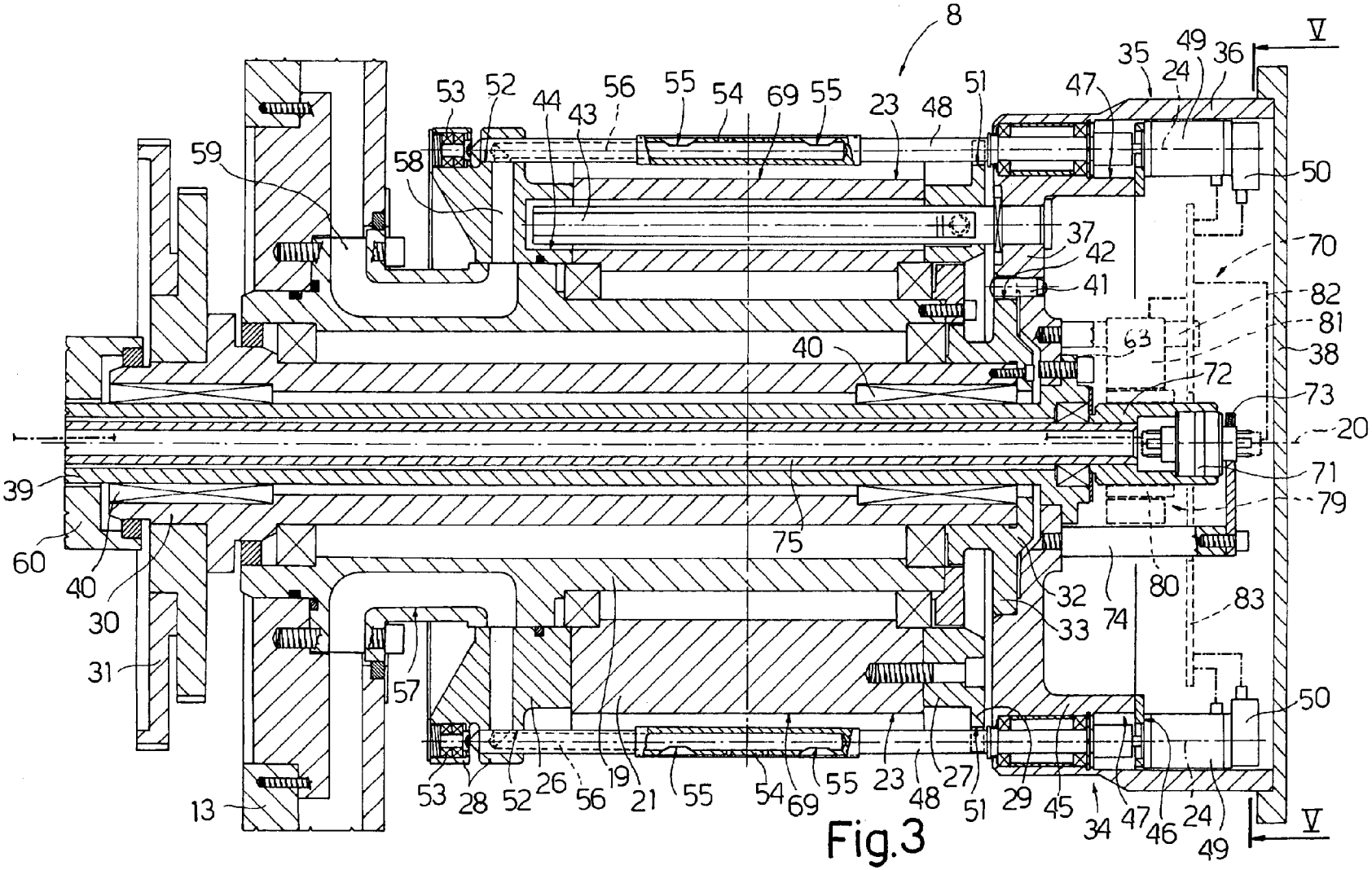
FIG. 3 shows a larger-scale detail of FIG. 1.

As shown in FIGS. 1 to 3, at rolling unit 8, frame 13 comprises a fixed tubular body 19 having an axis 20 parallel to axis 14, and supporting for rotation, via the interposition of bearings, an annular drum 21—hereinafter referred to as a "guide drum"—which is coaxial with axis 20, is fitted to tubular body 19 to rotate continuously clockwise, in FIG. 4, about axis 20, and forms part of rolling unit 8.

As shown more clearly in FIG. 4, guide drum 21 comprises a cylindrical outer surface 22 having semicylindrical longitudinal grooves or cavities 23, which are equally spaced about axis 20 with a spacing equal to spacing P1, and have axes 24 parallel to axis 20 and substantially coplanar with surface 22. Along a lateral downstream end edge (with reference to the rotation direction of guide drum 21), each cavity 23 has a start tooth 25 tangent to surface 22 and having an end edge projecting inside cavity 23. The opposite ends of guide drum 21 are defined by two annular plates 26 and 27 also having cavities 23; annular plate 26 faces frame 13 and has an outer flange 28; plate 27 has an outer flange 29; and flanges 28 and 29 axially define cavities 23, the total length of which is greater than that of a double cigarette 11.

A tubular drive shaft 30, coaxial with axis 20, is fitted for rotation through tubular body 19, and has a first end projecting inside frame 13 and fitted with a gear 31 connected in known manner (not shown) to a motor (not shown) of filter assembly machine 1, and a second end projecting outwards of the free end of tubular body 19 and fitted with an annular cap 32 having an outer flange 33.

In addition to guide drum 21, rolling unit 8 also comprises a drum 34—hereinafter referred to as a "rolling drum"—coaxial with axis 20 and in front of guide drum 21.

Rolling drum 34 comprises a cup-shaped body 35 located in front of guide drum 21 and in turn comprising a substantially cylindrical lateral wall 36 coaxial with axis 20 and closed, at the rear facing guide drum 21, by an annular end wall 37 facing flange 33, and, at the front, by a flat circular cover 38. A tubular shaft 39, coaxial with axis 20, extends through a central hole in end wall 37, and engages in rotary and axially-sliding manner a central hole of drive shaft 30, by which it is supported radially via the interposition of sliding bearings 40. A transmission pin 41, parallel to axis 20, projects rearwards from end wall 37, and, in normal working conditions, engages in axially-sliding manner a radial cavity 42, formed along the periphery of flange 33, to angularly connect drive shaft 30 and rolling drum 34. A transmission and guide pin 43 also projects rearwards from end wall 37, and engages in sliding manner a relative hole 44, formed parallel to axis 20 through guide drum 21 and annular plates 26 and 27, to make guide drum 21 and rolling drum 34 angularly integral with each other.

Lateral wall 36 of cup-shaped body 35 has a rear portion 45 thicker at the front and defined by an annular shoulder 46 in which axial through holes 47 are formed. Each hole 47 is coaxial with a respective axis 24, and houses for rotation an output shaft 48 of a respective drive unit defined by a respective electric "brushless" motor 49 located to the front of annular shoulder 46, having a respective encoder 50, and preferably of the type marketed under the trade name "ELCOM SL Brushless Series 3400".

In normal working conditions, each shaft 48 engages a respective radial cavity 51 formed on the outer periphery of flange 29, and an end portion of each shaft 48 engages a respective hole 52 formed, coaxially with respective axis 24, in flange 28 and housing a respective thrust bearing 53, on which the free end of relative shaft 48 rests. At a central portion facing a central portion of relative cavity 23 in said normal working conditions, each shaft 48 supports an externally knurled suction roller 54, which communicates, via a number of radial suction holes 55, with a conduit 56 formed inside relative shaft 48 and communicating, in said normal working conditions, with a suction circuit 57 comprising an end portion 58 formed through annular plate 26, and an annular header 59 formed on tubular body 19.

As shown more clearly in FIGS. 1 and 2, a rear end of drive shaft 30 projecting rearwards of gear 31 is fitted in rotary manner with the front end of an axial tubular appendix 60 of a cylindrical case 61 of a guide device 62 enabling rolling drum 34 to move axially with respect to guide drum 21. Guide device 62 comprises a tubular shaft 39, a front end of which projects inside cup-shaped body 35 and is connected integrally to end wall 37 by a flange 63, and a rear end of which projects rearwards of drive shaft 30, extends through tubular appendix 60, and penetrates case 61 to a length which, in normal working conditions, is shorter than the length of pin 43.

At the rear end, tubular shaft 39 supports a thrust bearing 64 for supporting an end fork 65 of a lever 66 hinged to case 61 and forming part of a lock device 67, which, besides lever 66, also comprises a linear actuator 68 hinged to case 61, interposed between case 61 and lever 66, and for rotating lever 66 backwards to releasably lock thrust bearing 64 in a withdrawn operating position (FIG. 1) corresponding to the position of rolling drum 34 in said normal working conditions, in which end wall 37 of cup-shaped body 35 contacts flange 33 of cap 32 of drive shaft 30, pin 41 engages relative cavity 42, the free ends of shafts 48 rest on relative bearings 53, and suction rollers 54 are positioned centrally along relative cavities 23 to define, with the surfaces of cavities 23, respective curved rolling channels 69 extending about respective axes 24, and the width of which is approximately equal to but no greater than the diameter of a double cigarette 11.

When lock device 67 is deactivated (FIG. 2), the operator can grip and pull out cup-shaped body 35 to release pin 41 from cavity 42 and so disconnect rolling drum 34 from drive shaft 30. Tubular shaft 39 is thus free to slide on bearings 40 to move thrust bearing 64 into a forward servicing position contacting the rear end of tubular appendix 60, and in which rolling drum 34 and relative shafts 48 are moved axially frontwards with respect to guide drum 21 to allow access to cavities 23 for cleaning and maintenance, while an end portion of pin 43 remains inside the relative hole to keep guide drum 21 and rolling drum 34 connected angularly to each other, and to guide rolling drum 34 when it is moved axially back into said withdrawn operating position.

Cup-shaped body 35 houses a known control device 70 (of the type described, for example, in EU-A-1 086 898) for controlling electric motors 49, and which comprises a fixed encoder 71 housed inside a sleeve 72 and having a rotor 73 fitted to a bracket 74 integral with end wall 37. Sleeve 72 is fitted to a front end of a tubular shaft 75, which is coaxial with axis 20, is supported in rotary manner by tubular shaft 39, and extends inside and along the whole length of tubular shaft 39. Tubular shaft 75 projects rearwards of thrust bearing 64, and is fitted integrally at the rear end with a bracket 76 supporting an antirotation pad 77, which engages in sliding manner a guide 78 formed, parallel to axis 20, along case 61.

In addition to encoder 71, control device 70 also comprises an electric collector 79, a stator 80 of which is supported by sleeve 72 and supplied by a line inside tubular shaft 75, and a rotor 81 of which is supported by a bracket 82 integral with end wall 37. Control device 70 also comprises an annular board 83, which is coaxial with axis 20, is supported by brackets 74 and 82, is supplied with direct current by electric collector 79, is driven by electric collector 79 as a function of the speed of filter assembly machine 1 and by encoder 71 as a function of the instantaneous angular position of annular board 83 about axis 20, and supplies and drives motors 49 successively as a function of their angular position about axis 20, and with negative feedback on relative encoders 50.

Operation of rolling unit 8 will now be described with reference to FIGS. 6 and 7 and relative to the formation of one double cigarette 11, as of the instant in which the relative group 4 is fed (FIG. 6*a*) to transfer station 9 in time with a relative suction roller 54 positioned with its radial suction hole 55 facing radially outwards with respect to axis 20 to engage a relative double filter 6 with the interposition of a relative double band 7 and two relative cigarette portions 5.

At the above instant (corresponding to instant A in the FIG. 7 graph), rolling unit 8, rotated at substantially constant speed about axis 20, has a peripheral speed, at the outlet of hole 55, substantially equal to the peripheral speed of feed drum 3, and relative motor 49 keeps suction roller 54 substantially stationary with respect to guide drum 21.

Once relative group 4 is received at transfer station 9, suction roller 54 is withdrawn from transfer station 9 by rolling unit 8 rotating clockwise about axis 20, and is rotated by relative motor 49 about relative axis 24 in the same direction as rolling unit 8, until relative group 4 encounters relative start tooth 25. Group 4 strikes start tooth 25 (FIG. 6*b* and point B in the FIG. 7 graph) within a time interval in which suction roller 54 is gradually accelerated, but at an instant in which the angular speed of suction roller 54 is still relatively low, so as to minimize any possible damage by such impact, which dislodges group 4 from radial suction hole 55 and gradually rolls group 4 along relative rolling channel 69 (FIGS. 6*c* and 6*d*). As shown in FIG. 7, rolling, which involves at least two turns of group 4, is performed first at increasing angular speed and then at decreasing angular speed of suction roller 54, which is sized to make 1.5 full turns about axis 24 in the time taken by relative group 4 to roll along the whole of relative rolling channel 69 and so form a relative double cigarette 11. Each double cigarette 11 therefore reaches the output end of relative rolling channel 69 in time with relative radial suction hole 55 of relative suction roller 54.

Figure 7:
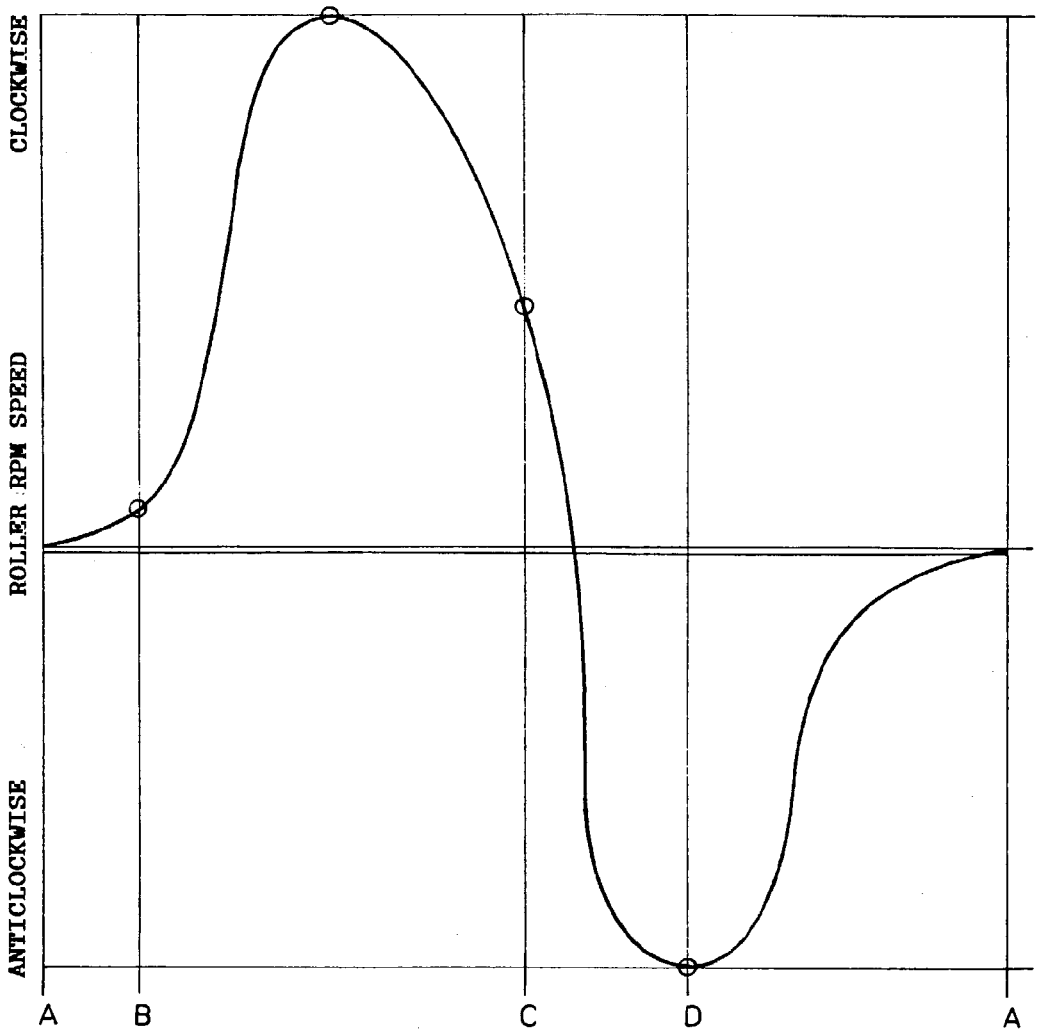
FIG. 7 shows a graph of the variation in angular speed of a detail in FIG. 6.

Once relative double cigarette 11 is extracted from relative rolling channel 69 (point C in the FIG. 7 graph) at relatively low speed to ensure pickup, suction roller 54 continues rotating, and decelerating, about relative axis 24 integrally with relative double cigarette 11 and in the same direction as rolling unit 8, until it is eventually reversed and reaches a maximum opposite angular speed at point D in the FIG. 7 graph, which corresponds to double cigarette 11 reaching transfer station 12.

As shown in FIG. 4, output drum 10 is fitted to fixed frame 13 (FIGS. 1 and 2) to rotate, with respect to frame 13, continuously anticlockwise, in FIG. 4, about a horizontal axis 84 parallel to axis 20, and comprises, on a lateral surface 85, a number of longitudinal seats 86 equally spaced about axis 84 with a spacing P2 smaller than P1, and for receiving and retaining respective double cigarettes 11 by suction by means of substantially radial suction channels 87.

Since spacing P2 is smaller than spacing P1 (the P1 to P2 ratio is actually about 4/3), the peripheral speed of output drum 10 is lower than that of feed drum 3, and the opposite angular speed of suction roller 54 considered is so regulated by annular board 83 that, at transfer station 12, the resulting traveling speed of relative double cigarette 11 about axis 20 (equal to the speed produced by rotation of rolling unit 8 minus the speed produced by relative suction roller 54 rotating in the opposite direction with respect to rolling unit 8) equals the traveling speed of relative seat 86, double cigarette 11 is synchronized with relative seat 86, and transfer, together with a simultaneous reduction in spacing, of double cigarette 11 to output drum 10 can be made safely with no risk of damage to double cigarette 11.

Once relative double cigarette 11 is released, suction roller 54 continues past transfer station 12, still rotating in the opposite direction to rolling unit 8, but gradually slowing down until it eventually stops as it travels through transfer station 9 (point A in the FIG. 7 graph) and substantially upon receiving the next group 4.

In connection with the above, it should be pointed out that the reduction in spacing from P1 to P2, allowed by motors 49 being independent of drive shaft 30, is extremely important by enabling a reduction in size and/or angular speed of all the drums downstream from rolling unit 8.

Figure 10:
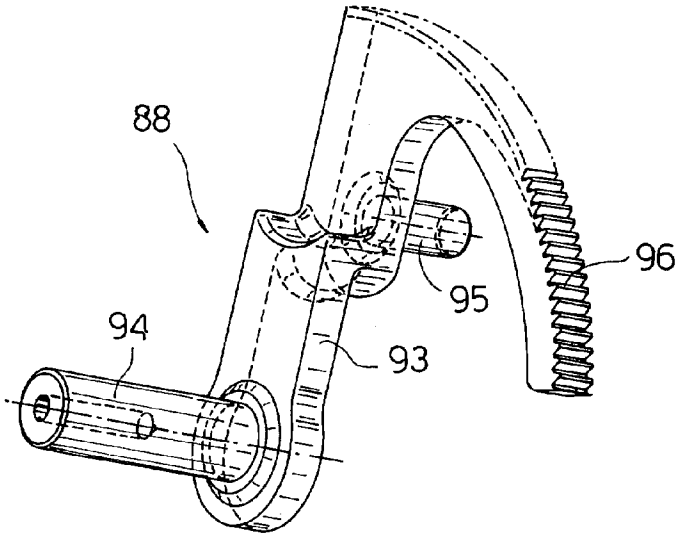
FIG. 10 shows a larger-scale view in perspective of a detail in FIG. 9.
Figure 8:
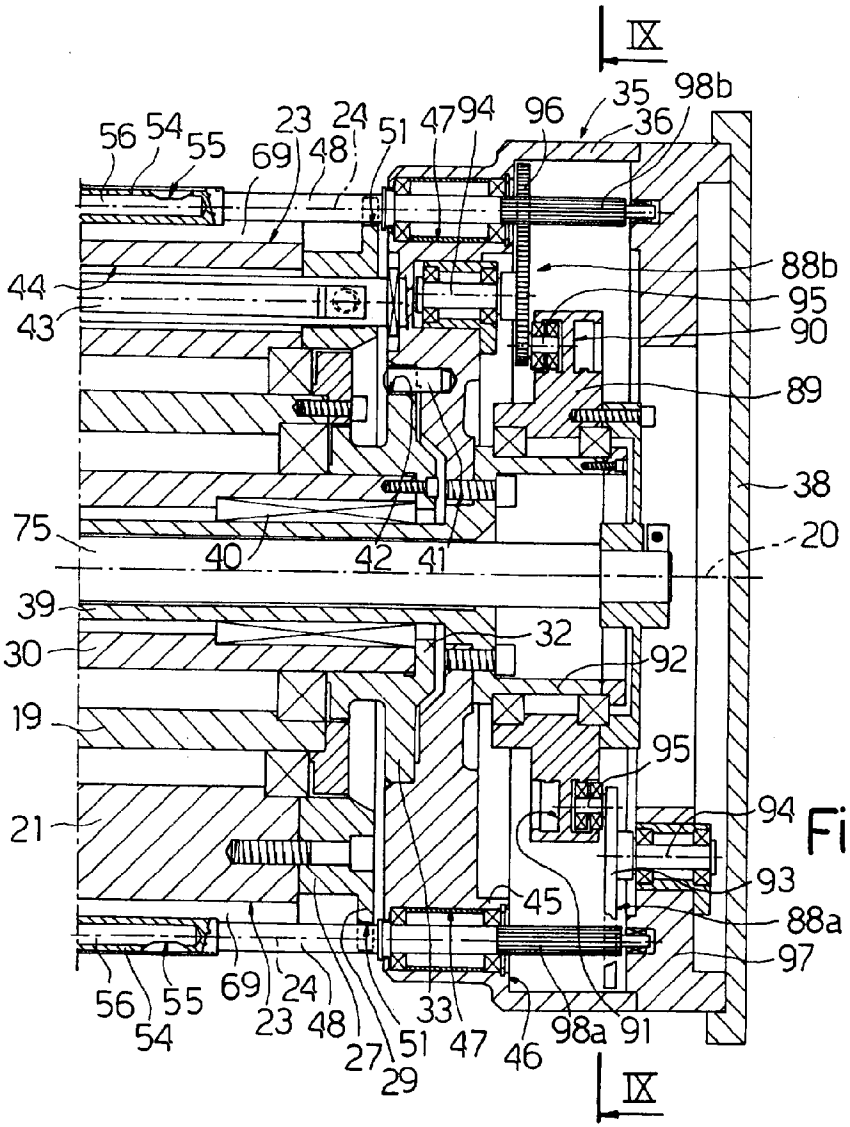
FIG. 8 is similar to FIG. 3, and shows a partial axial section of a variation of the rolling unit in FIGS. 1 to 3.
Figure 9:
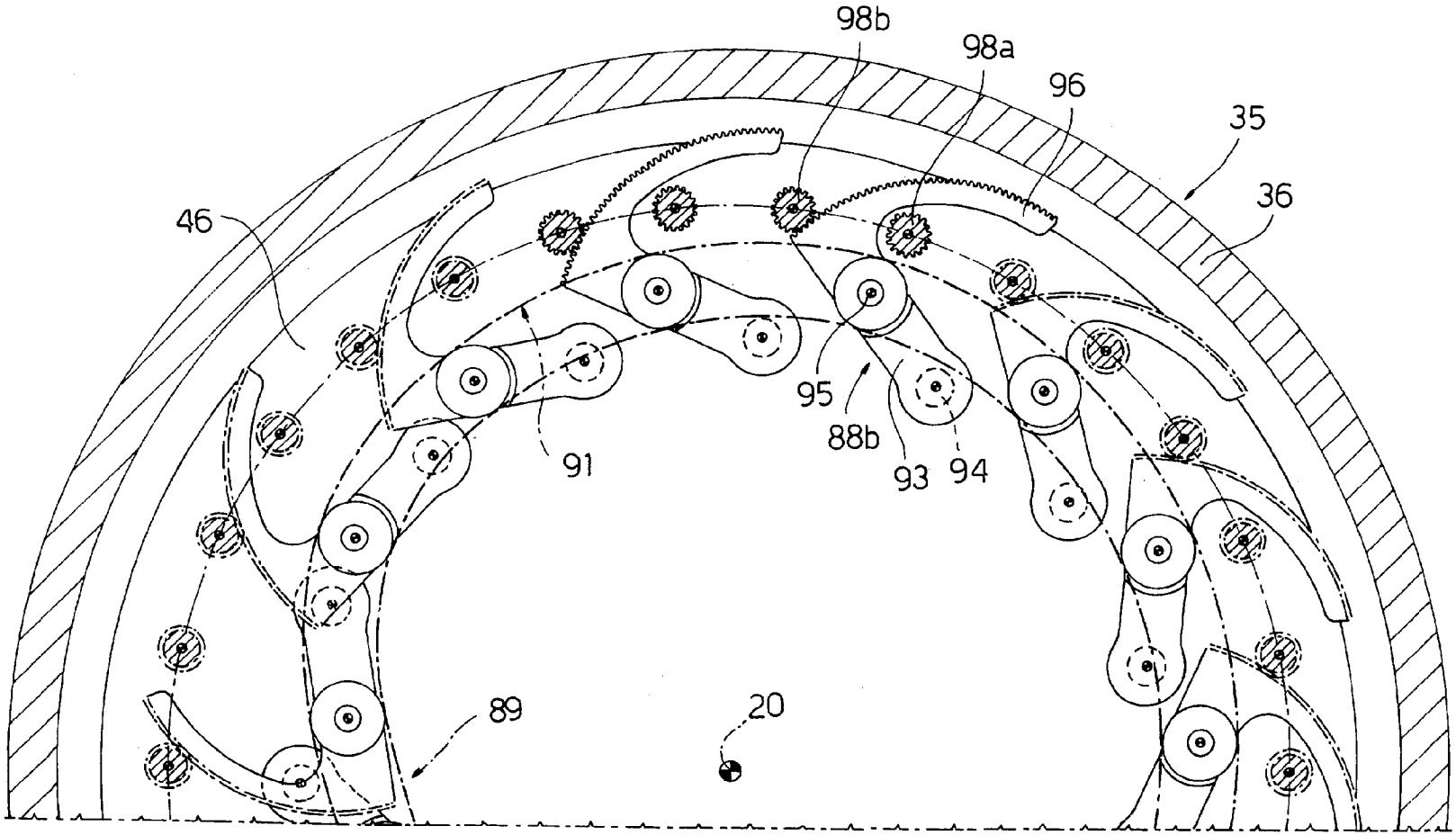
FIG. 9 shows a section along line IX–IX in FIG. 8.

In the FIGS. 8–10 variation, as opposed to independent electric motors, suction rollers 54 are rotated by respective mechanical operating units 88 housed inside cup-shaped body 35 in place of motors 49. Operating units 88 are controlled by a fixed annular cam 89, which is housed inside cup-shaped body 35 in place of control device 70, is connected integrally to a front end of shaft 75 (which, in this case, may be solid as opposed to tubular), is crosswise to axis 20, and comprises a front track 90 and an identical rear track 91. Cam 89 is fitted in rotary manner, via the interposition of bearings, to the outer surface of a tubular appendix 92 extending frontwards and coaxially with axis 20 from end wall 37, and tracks 90 and 91 cooperate with respective numbers of operating units—indicated 88*a* and 88*b* respectively—comprising respective levers 93, each of which has an end hinge pin 94 parallel to axis 20, an intermediate tappet pin 95 parallel to hinge pin 94, and an externally toothed sector gear 96 extending, in a plane crosswise to axis 20, from the opposite end of lever 93 to that supporting hinge pin 94.

More specifically, levers 93 of operating units 88*a* are hinged, by respective hinge pins 94, to an annular flange 97 projecting inwards from lateral wall 36 and in front of the end of shaft 75, and their tappet pins 95 engage track 90 of cam 89; and levers 93 of operating units 88*b* are hinged, by respective hinge pins 94, to end wall 37, and their tappet pins 95 engage track 91 of cam 89.

As shown in FIG. 8, the front end of each shaft 48 is connected for rotation to flange 97, and the portion of each shaft 48 extending between flange 97 and end wall 37 forms a pinion 98, which meshes with a respective sector gear 96 of a respective operating unit 88. More specifically, in the succession of pinions 98 arranged about axis 20 inside cup-shaped body 35, each pair of adjacent pinions 98 comprises a pinion 98*a* meshing with the sector gear 96 of a respective operating unit 88*a*, and a pinion 98*b* meshing with the sector gear 96 of a respective operating unit 88*b*.

By duplicating the number of tracks on cam 89, by placing operating units 88*a* in front of, and operating units 88*b* behind, cam 89, and by arranging operating units 88*a* and 88*b* alternately about axis 20, all the sector gears 96 required can be housed inside cup-shaped body 35 without interfering with one another in use.

Cam 89 is obviously designed to impart to pinions 98, and therefore to relative suction rollers 54, substantially the same motion imparted to suction rollers 54 by motors 49 and shown in the FIG. 7 graph.

The invention claimed is:

1. A cigarette filter assembly machine comprising a rolling unit (8) rotating about a first axis (20) and interposed between a feed drum (3) for supplying a succession of groups (4) equally spaced with a first spacing (P1) and each defined by component elements (5, 6, 7) of a relative double filter-tipped cigarette (11), and an output drum (10) for receiving a succession of double cigarettes (11) equally spaced with a second spacing (P2);

the rolling unit (8) comprising:

a number of suction rollers (54) for supporting respective, groups (4), having a generally circular cross section, and mounted to rotate about respective second axes (24) parallel to the first axis (20) and equally spaced about the first axis (20);

actuating means (49, 70)(88, 89) for rotating each suction roller (54) about the relative second axis (24) and comprising a number of independent reversible drive units (49) (88), each connected to a respective said suction roller (54) to rotate the suction roller (54) about the relative said second axis (24) at a variable speed and in both clockwise and counterclockwise directions during a rotation about said first axis (20) and while the suction roller (54) supports a respective group (4); and a number of semicylindrical cavities (23), each of which faces outwards, is coaxial with a relative second axis (24), and defines a relative rolling channel (69) about a relative suction roller (54).

2. A machine as claimed in claim 1, wherein said rolling unit (8) is connected to said feed drum (3) at a first transfer station (9), and to said output drum (10) at a second transfer station (12); said actuating means (49, 70)(88, 89) imparting, to each said suction roller (54), rotation in the same direction as rotation of said rolling unit (8) downstream from said first transfer station (9), and inverse rotation prior to reaching said second transfer station (12).

3. A machine as claimed in claim 1, wherein said actuating means (49, 70)(88, 89) impart, to each said suction roller (54), a substantially zero angular speed at said first transfer station (9).

4. A machine as claimed in claim 1, wherein said rolling unit (8) comprises a rolling drum (34) and a guide drum (21) coaxial with each other and with said first axis (20); and first connecting means interposed between said guide drum (21) and said rolling drum (34) to connect the guide drum (21) and the rolling drum (34) to each other in angularly-fixed, axially-sliding manner; said suction rollers (54) being supported by said rolling drum (34), and said guide drum (21) carrying said cavities (23) externally.

5. A machine as claimed in claim 4, wherein said rolling unit (8) comprises a first tubular shaft (30) coaxial with said guide drum (21) and said rolling drum (34); the first tubular shaft (30) being a drive shaft for driving said rolling unit (8); and second connecting means (41) being provided to connect said first tubular shaft (30) and said rolling drum (34) angularly to each other.

6. A machine as claimed in claim 5, wherein said rolling unit (8) also comprises a second tubular shaft (39) integral with said rolling drum (34), coaxial with the first tubular shaft (30), and extending inside and through the first tubular shaft (30); the second tubular shaft (39) being connected to the first tubular shaft (30) to slide axially between an operating position angularly connecting said guide drum (21) and said rolling drum (34) to said first tubular shaft (30), and a servicing position wherein said guide drum (21) and said rolling drum (34) are disconnected from said first tubular shaft (30) and offset axially with respect to each other.

7. A machine as claimed in claim 6, wherein said second connecting means (41) are carried by said rolling drum (34), and are connected in axially-sliding manner to said first tubular shaft (30) when said second tubular shaft (39) is in said operating position.

8. A machine as claimed in claim 6, wherein said rolling drum (34) is located in front of said guide drum (21); said suction rollers (54) projecting from the rear of said rolling drum (34), being located in front of respective said cavities (23) when in said operating position, and being offset axially with respect to respective said cavities (23) when in said servicing position.

9. A machine as claimed in claim 6, wherein locking means (67) are associated with said second tubular shaft (39) to lock the second tubular shaft (39) releasably in said operating position.

10. A machine as claimed in claim 6, and comprising a third shaft (75) coaxial with said first and said second tubular shaft (30, 39) and fitted inside and through said second tubular shaft (39); said third shaft (75) being connected in rotary manner to said second tubular shaft (39), and being angularly fixed; and control means (70) (89) for controlling said drive units (49) (88) being supported by said third shaft (75) in an angularly fixed position on said rolling drum (34).

11. A machine as claimed in claim 1, wherein each said drive unit (49) comprises a relative brushless motor (49) having an output connected to a relative said suction roller (54).

12. A machine as claimed in claim 11, wherein each said brushless motor (49) is supported by a rolling drum (34).

13. A machine as claimed in claim 11, wherein said actuating means (70) comprise a first encoder (71) supported by a third shaft (75) and interposed between the third shaft (75) and a rolling drum (34); an electric collector (79) in turn comprising a stator (80), and a rotor (81) integral with said rolling drum (34), said stator (80) receiving supply current and a number of machine signals; a board (83) integral with said rolling drum (34); and a number of second encoders (50), each associated with a respective said brushless motor (49); said board (83) being interposed between said rotor (81) and said brushless motors (49), being driven by said electric collector (79) as a function of a speed of the filter assembly machine (1) and by said first encoder (71) as a function of an instantaneous angular position of the board (83) about said first axis (20), and supplying and driving said brushless motors successively as a function of an angular position of the brushless motors (49) about said first axis (20) and with negative feedback on the relative said second encoders (50).

14. A machine as claimed in claim 1, wherein each said drive unit (88) comprises a relative sector gear (96) which oscillates, about a respective third axis (94) parallel to a relative said second axis (24); and a pinion (98) coaxial with said second axis (24), connected angularly to the relative said suction roller (54), and meshing with said sector gear (96).

15. A machine as claimed in claim 14, wherein each said sector gear (96) is supported by a said rolling drum (34).

16. A machine as claimed in claim 15, wherein said actuating means (89) comprise a fixed cam (89) extending about said first axis (20); and tappet means (95) connected in sliding manner to said cam (89) and carried by each said sector gear (96).

17. A machine as claimed in claim 16, wherein said drive units (88) are divided into a first and a second number of drive units (88*a*, 88*b*) located on opposite sides of said cam (89), which has two identical opposite tracks (90, 91), each engaged by the tappet means (95) of the respective number of drive units (88*a*, 88*b*).

18. A machine as claimed in claim 17, wherein said pinions (98) are equally spaced about said first axis (20); in each pair of adjacent said pinions (98), a first pinion (98*a*) being connected to a drive unit (88*a*) in the said first number, and a second pinion (98*b*) being connected to a drive unit (88*b*) in said second number.

19. A cigarette filter assembly machine comprising a rolling unit (8) rotating about a first axis (20) and interposed between a feed drum (3) for supplying a succession of groups (4) equally spaced with a first spacing (P1) and each defined by component elements (5, 6, 7) of a relative double filter-tipped cigarette (11), and an output drum (10) for receiving a succession of double cigarettes (11) equally spaced with a second spacing (P2);

the rolling unit (8) comprising:

a number of suction rollers (54) mounted to rotate about respective second axes (24) parallel to the first axis (20) and equally spaced about the first axis (20);

actuating means (49, 70)(88, 89) for rotating each suction roller (54) about the relative second axis (24) and comprising a number of independent reversible drive units (49) (88), each connected to a respective said suction roller (54) to rotate the suction roller (54) about the relative said second axis (24) at a variable speed and in both clockwise and counterclockwise directions during a rotation about said first axis (20);

a number of semicylindrical cavities (23), each of which faces outwards, is coaxial with a relative second axis (24), and defines a relative rolling channel (69) about a relative suction roller (54);

a rolling drum (34) and a guide drum (21) coaxial with each other and with said first axis (20);

first connecting means interposed between said guide drum (21) and said rolling drum (34) to connect the guide drum (21) and the rolling drum (34) to each other in angularly-fixed, axially-sliding manner; wherein said suction rollers (54) are supported by said rolling drum (34), and said guide drum (21) carrying said cavities (23) externally;

a first tubular shaft (30) coaxial with said guide drum (21) and said rolling drum (34); wherein the first tubular shaft (30) is a drive shaft for driving said rolling unit (8), and second connecting means (41) are provided to connect said first tubular shaft (30) and said rolling drum (34) angularly to each other; and a second tubular shaft (39) integral with said rolling drum (34), coaxial with the first tubular shaft (30), and extending inside and through the first tubular shaft (30); wherein the second tubular shaft (39) is connected to the first tubular shaft (30) to slide axially between an operating position angularly connecting said guide drum (21) and said rolling drum (34) to said first tubular shaft (30), and a servicing position in which said guide drum (21) and said rolling drum (34) are disconnected from said first tubular shaft (30) and offset axially with respect to each other.

20. A cigarette filter assembly machine comprising a rolling unit (8) rotating about a first axis (20) and interposed between a feed drum (3) for supplying a succession of groups (4) equally spaced with a first spacing (P1) and each defined by component elements (5, 6, 7) of a relative double filter-tipped cigarette (11), and an output drum (10) for receiving a succession of double cigarettes (11) equally spaced with a second spacing (P2) smaller than the first spacing (P1);

the rolling unit (8) comprising:

a number of suction rollers (54) for supporting respective groups (4), having a generally circular cross section, and mounted to rotate about respective second axes (24) parallel to the first axis (20) and equally spaced about the first axis (20);

actuating means (49, 70)(88, 89) for rotating each suction roller (54) about the relative second axis (24) and comprising a number of independent reversible drive units (49) (88), each connected to a respective said suction roller (54) to rotate the suction roller (54) about the relative said second axis (24) at a variable speed and in both clockwise and counterclockwise directions during a rotation about said first axis (20) and while the suction roller (54) supports a respective group (4); and a number of semicylindrical cavities (23), each of which faces outwards, is coaxial with a relative second axis (24), and defines a relative rolling channel (69) about a relative suction roller (54);

wherein the actuating means (49, 70)(88, 89) rotate each suction roller (54) about the relative second axis (24) at a maximum opposite angular speed when the suction roller (54) reaches a transfer station (12) between the rolling unit (8) and the output drum (10) so as the resulting traveling speed of each double cigarette (11) about the first axis (20) equals the traveling speed of a relative seat (86) of the output drum (10) and the double cigarette (11) can be transferred to the relative seat (86) of the output drum (10) together with a simultaneous reduction in spacing.

* * * * *

UNITED STATES PATENT AND TRADEMARK OFFICE

CERTIFICATE OF CORRECTION

PATENT NO. : 7,226,404 B2
APPLICATION NO. : 10/349662
DATED : June 5, 2007
INVENTOR(S) : Salvatore Rizzoli et al.

It is certified that error appears in the above-identified patent and that said Letters Patent is hereby corrected as shown below:

On the Title Page:

At field (73), "Societa" should be -- Societa´ --.

In the Claims:

At Column 7, line 33, "respective," should be -- respective --.

At Column 9, line 8, "oscillates," should be -- oscillates --.

Signed and Sealed this

Twentieth Day of November, 2007

JON W. DUDAS
*Director of the United States Patent and Trademark Office*